US006364819B1

(12) United States Patent
Shinno et al.

(10) Patent No.: US 6,364,819 B1
(45) Date of Patent: Apr. 2, 2002

(54) FASTENING DEVICE FOR JOINING TWO PLATES TOGETHER

(75) Inventors: Yoshiaki Shinno, Usa; Toshikazu Sanda, Fukuoka; Minoru Isayama, Usa; Kazuhiro Baba, Hirakata; Yuko Ogawa, Ajimumachi, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/390,689

(22) Filed: Sep. 7, 1999

(Under 37 CFR 1.47)

(30) Foreign Application Priority Data

Sep. 7, 1998 (JP) ..... 10-252408

(51) Int. Cl.[7] ..... B31B 1/60

(52) U.S. Cl. ..... 493/84; 493/136; 493/390; 53/484

(58) Field of Search ..... 493/84, 136, 137, 493/139, 374, 379, 390, 383, 393; 206/309; 53/484

(56) References Cited

U.S. PATENT DOCUMENTS 3,748,971 A * 7/1973 Grundell
5,251,749 A * 10/1993 Knight
5,934,473 A * 8/1999 Belshe

FOREIGN PATENT DOCUMENTS

JP 51-74784 6/1976
JP S57-134217 2/1981
JP S63-3927 12/1998

* cited by examiner

*Primary Examiner*—Eugene Kim
(74) *Attorney, Agent, or Firm*—McDermott, Will & Emery

(57) ABSTRACT

A fastening device includes a cylindrical shell with an opening extending over the entire length of the cylindrical shell, a gripping member formed on the periphery of the cylindrical shell by extending outward and a pair of hooks linked with the tip end of the cylindrical shell via hinges. A fastening method using the foregoing fastening device includes the steps of passing the pair of hooks through a hole for fastening of a packing box formed of an upper box and a lower box, having the pair of hooks opened outward to bring the holding members thereof into contact with the back side surface of the packing box and at the same time having the pair of hooks engaged with each other firmly. At this time, the gripping member is in contact with the front side surface of the packing box. Accordingly, both surfaces located at each respective rim of the hole for fastening are sandwiched between the pair of hooks and the gripping member. Furthermore, the fastening device is structured to make the position of engagement between the pair of hooks changeable, thereby allowing the angle of each respective hook against the cylindrical shell to change and allowing consequently the sandwiching distance between the gripping member and the pair of hooks to change.

30 Claims, 11 Drawing Sheets

FASTENING DEVICE FOR JOINING TWO PLATES TOGETHER

FIELD OF THE INVENTION

The present invention relates to a fastening device for joining two plates together and more specifically relates to a fastening device for joining an upper box and a lower box together, the boxes being intended for use in containing large equipment, heavy equipment and the like.

BACKROUND OF THE INVENTION

As FIG. 8 shows, packing of large or heavy equipment such as a television receiver, a display device, a copy machine and the like is generally performed by using an upper box 1 and a lower box 2, both of which are made of a corrugated cardboard and the like, and joining the upper box 1 and lower box 2 together in order to facilitate a packing operation and an unpacking operation as well. As a means for joining the two boxes together, a band 3 is used.

However, the packing system of this type has such drawbacks as loosening and sometimes tearing off of the band 3 during transportation. As a remedy for these drawbacks, a fastening device for packing as disclosed in the Japanese Unexamined Patent Publication TOKUKO-SHOW-56-28778 and the like has been in use.

As FIG. 9 shows, a fastening device 4 is pressed into a hole 5 for fastening that is provided as a common hole on the upper box 1 and lower box 2, thereby joining the upper box 1 and lower box 2 together. Further, this fastening device 4 is serving as a grip for holding the packing box.

Next, a detailed description is given to the fastening device 4. As FIG. 10 and FIG. 11 show, the fastening device 4 comprises a cylindrical shell 7 with dose to a square in cross section, a flange 6 formed on the edge of one opening of the cylindrical shell 7 by extending outward, a pair of hooks 8, each of which has an L-letter like shape in cross section and is linked, respectively, via a hinge 7*a* to one of the two sides that are opposing to each other and located on the other opening of the cylindrical shell 7 and a tab 9 formed on the upper surface of one of the pair of hooks 8. All the parts of the fastening device 4 are molded in one piece to realize a sing-piece construction by the use of a polypropylene material which shows elasticity to a degree.

As FIG. 12 shows, the pair of hooks 8 and the cylindrical shell 7 are inserted in a hole 5 for fastening that is formed as the common hole on the upper box 1 and lower box 2. Then, as FIG. 13 shows, the tab 9 is pushed upward, thereby having the pair of hooks 8 opened outward. Each respective hook 8 is opened outward by 90° from the original upright position thereof, thereby having part of each respective hook 8 brought into contact with the perimeter of the hole 5 for fastening inside of the lower box 2 and at the same time having the remaining part of each respective hook 8 brought into contact with the inner side of the lower box 2. On the other hand, the flange 6 is made to contact the perimeter of the hole 5 for fastening outside of the upper box 1. Accordingly, the fastening device 4 is disposed in the holes 5 for fastening of the upper box 1 and lower box 2 as if the peripheries of the common hole 5 for fastening are sandwiched between the foregoing hook 8 and flange 6. Further, the tab 9 formed on the upper surface of one of the pair of hooks 8 is turned by 90°, thereby getting inside of the cylindrical shell 7. The tip end of the tab 9 is made to engage with a retainer 8*a* provided on the opposing hook 8. Thus, the pair of hooks 8 are fixed in a state of being opened outward.

However, the thickness of the upper box 1 and lower box 2 usually changes according to the kind or weight of the equipment to be packed. Since the prior art fastening device as described above has a fixed predetermined distance between the pair of hooks 8 opened outward and the flange 6, it has been having a problem of inability to cope with the situation where the packing box has a thickness that is different from the one, to which the fastening device in question is designed. Therefore, for use with a variety of packing boxes having a thickness different from one another, a variety of fastening devices with the sandwiching distance between a pair of hooks and a flange made different from one another have to be prepared, resulting in an adverse effect on the economic aspect involved therewith.

SUMMARY OF THE INVENTION

A fastening device and a fasting method of the present invention comprise a shell with an opening extending over the entire length of the shell, a gripping member formed on the periphery of the cylindrical shell by extending outward, and a pair of hooks linked with the tip end of the cylindrical shell via hinges.

The pair of hooks is placed in a hole for fastening of each of a first plate and a second plate. Then, each of the pair of hooks are opened outward to bring holding members thereof into contact with the bottom surface of the plate situated on the back side, and at the same time, the pair of hooks are engaged with each other firmly. At this time, the gripping member is in contact with the front surface of the plate situated on the front side. Accordingly, the two plates are sandwiched on both outer surfaces thereof at each respective rim of the hole for fastening between the pair of hooks and the gripping member. Furthermore, the fastening device is structured so as to make the position of engagement between the pair of hooks changeable, thereby allowing the angle of each respective hook against the cylindrical shell to change and allowing consequently the sandwiching distance between the gripping member and the pair of hooks to change.

A particularly preferred embodiment of the present invention is the case where the foregoing first plate and second plate are an upper box and a lower box, respectively, to be joined together for building a packing box.

According to the structure as described above, the sandwiching distance between the pair of hooks and the gripping member is made changeable. Therefore, even when the first plate (or the upper box) and the second plate (or the lower box) constituting a packing box have a difference in thickness therebetween, the fastening device prepared as above can join the first plate (the upper box) and the second plate (or lower box) together readily and firmly.

KEY TO REFERENCE ALPHANUMERIC CHARACTERS

Figure 1:
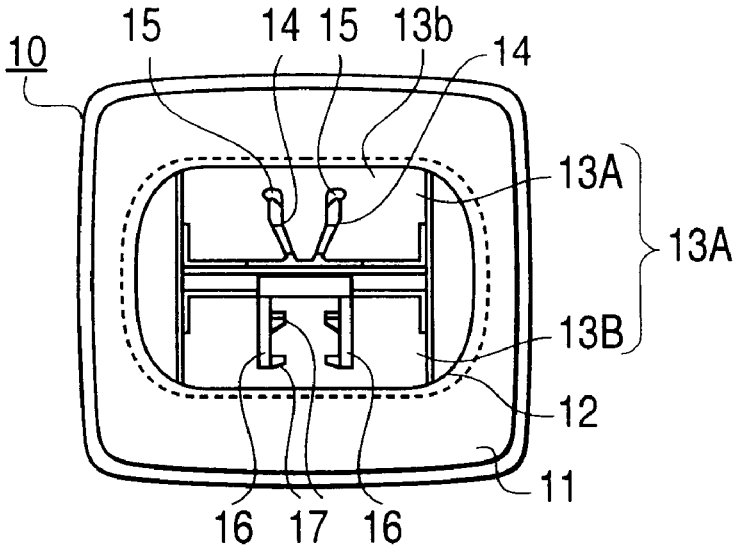
FIG. 1 is a front view of a fastening device in an exemplary embodiment of the present invention.

10 Fastening Device
11 Flange, Gripping Member
12 Cylindrical Shell
13 A Pair of Hooks
13A A First Hook
13B A Second Hook
13A*a,* 13B*a* Holding Member
13A*b,* 13B*b* Closing Member
14 Tab
15 Engaging Member
16 Rib
17 A Plurality of Engagement Notches
18 Upper Box
19 Lower Box
20 Hole for Fastening

DETAILED DESCRIPTION OF PREFERRED EMBODIMENTS

A fastening device in an exemplary embodiment of the present invention comprises:

(a) a shell provided with a first opening and a second opening,
  in which continuity exists between the first opening and the second opening;
(b) a gripping member formed on the periphery of the shell near the first opening or on the end of the cylindrical shell at the first opening by extending outward;
(c) a pair of hooks provided on the inner surface of the shell near the second opening or on the end of the shell at the second opening,
  in which the pair of hooks comprise
    a first hook formed to link with a first side of the second opening via a first hinge, and
    a second hook formed to link with a second side of the second opening via a second hinge,
      the second side is located opposite to the first side,
      the first hook comprises
        a first vertical member linked to the first hinge,
        a first holding member formed on the outside surface of the first vertical member by extending outward from there, and
        a first closing member formed on the inside surface of the first vertical member by extending inward from there, and
      the second hook comprises,
        a second vertical member linked to the second hinge, and
        a second holding member formed on the outside surface of the second vertical member by extending outward from there,
(d) an engaging member provided on the inside surface of at least one of the first closing member and the first vertical member, and
(e) a plurality of engagement notches provided on the inside surface of at least one of the second closing member and the second vertical member.

The foregoing first hook and second hook are allowed to open outward and dose inward by having the first closing member pushed in and pulled out, respectively. The foregoing engaging member is allowed to engage with the plurality of engagement notches. By having the engaging member engaged with one engagement notch selected from the plurality of engagement notches, both the first hook and second hook are allowed to change respective angles thereof against the shell. By adjusting the foregoing angles, the distance between the gripping member and the pair of hooks is allowed to change accordingly. A first plate provided with a hole for fastening and a second plate also provided with the hole for fastening are put together so that the respective holes for fastening may coincide with each other in position and then, after the foregoing pair of hooks and shell have been pushed into the hole for fastening provided on the combination of the two plates, each respective hook of the pair of hooks is opened outward, thereby, while bringing the outside surfaces of the first holding member and second holding member into contact with the edge and ajoining surface around the hole for fastening, having the edge and adjoining surface around the hole for fastening of the first plate and second plate sandwiched between the first and second holding members and the gripping member and at the same time having the engaging member engaged with the engagement notch and thus allowing the first plate and second plate to be joined together by fastening. Accordingly, by having the engaging member engaged with one engagement notch selected from the plurality of engagement notches, the angle of each respective holding member against the shell can be changed, thereby allowing the sandwiching distance to be varied. As a result, it has become possible to have plates, each of which has a thickness different from before or others, joined together more readily.

A fastening method in an exemplary embodiment of the present invention comprises the steps of:

(1) supplying the foregoing fastening device,
  in which, the device comprises
    (a) a shell provided with a first opening and a second opening, in which continuity exists between the first opening and the second opening,
    (b) a gripping member formed on the periphery of the first opening by extending outward;
    (c) a pair of hooks provided in the vicinity around the second opening, in which the pair of hooks comprise a first hook formed to link with a first side of the second opening via a first hinge, and a second hook formed to link with a second side of the second opening via a second hinge,
      the second side is located opposite to the first side,
      the first hook comprises a first vertical member linked to the first hinge, a first holding member formed on the outer surface of the first vertical member by extending outward from there, and a first closing member formed on the inner surface of the first vertical member by extending inward from there, and the second hook comprises a second vertical member linked to the second hinge, and a second holding member formed on the outside surface of the second vertical member by extending outward from there;

(d) an engaging member provided on the inside surface of at least one of the first closing member and the first vertical member, and (e) a plurality of engagement notches provided on the inside surface of at least one of the second closing member and the second vertical member, (2) overlaying a first plate on a second plate so that an first hole formed on the first plate is aligned with a second hole formed on the second plate, (3) inserting the fastening device into the first hole and second hole and pushing in the fastening device untill the gripping member comes to contact with the the surface of the first plate, (4) opening outward the first hook and second hook while pushing in the first closing member, thereby bringing the first holding member and second holding member into contact with the surface of the second plate to have the first plate and second plate sandwiched between the first holding member and second holding member and the gripping member; and (5) joining firmly the first plate and second plate together by the pair of hooks with the engaging member made to engage with one of the plurality of engagement notches, in which, by selecting arbitrarily one engagement notch from the plurality of engagement notches, the angles of both the first holding member and second holding member against the shell changes and at the same time the distance between the gripping member and the pair of hooks is adjusted to become equal to the total thickness of the first plate and second plate put together.

Accordingly, by having the engaging member engaged with one engagement notch selected from the plurality of engagement notches, the angle of each respective holding member against the shell can be changed, thereby making it possible for the sandwiching distance to be varied. As a result, it has become possible to have plates, each of which has a thickness different from before or others, joined together more readily.

Particularly preferred is that the foregoing first plate is an upper box and the second plate is a lower box and, by joining the upper box and lower box together, a box is built.

Particularly preferred is that each of the plurality of engagement notches is located on a circular trail of the engaging member as it moves by rotating around the first hinge.

Particularly preferred is that the engaging member is a protrusion formed on the tip end of the first closing member by extending toward the second holding member.

Particularly preferred is that a tab is further disposed on at least one of the inside surfaces of the first closing member and the first vertical member and the engaging member is formed on the tip end by protruding from the foregoing tab.

Particularly preferred is that the first hook has close to a T-letter like shape in cross section and the outside surface of the first holding member and the outside surface of the first closing member are in the same plane.

Particularly preferred is that the second hook further has a second closing member protruding from the inside surface of the second vertical member and has dose to a T-letter like shape in cross section and the purality of engagement notches are disposed on both the vertical member and the second closing member.

Particularly preferred is that the second hook has the second closing member protruding from the inside surface of the second vertical member and further a slanting member provided between the second vertical member and the second closing member, and the plurality of the engagement notches are provided on the slanting member and each of the plurality of engagement notches is located on a circular trail of the engaging member as it moves by rotating around the first hinge.

Particularly preferred is that the first hook and second hook have close to a T-letter like shape in cross section, respectively.

Particularly preferred is that the gripping member is a flange.

Particularly preferred is that the fastening device has a protrusion formed on the tip end of the foregoing tab by extending toward the second hook, and each of the plurality of engagement notches is located on a circular trail of the engaging member as it moves rotating around the first hinge and at the same time the foregoing protrusion is brought into contact with the second hook when the foregoing tab is pushed in, thereby allowing the second hook to rotate arond the second hinge. More specifically, a tab on one hook of a pair of hooks has an engaging member formed on the end tip thereof by protruding toward the opposing hook, and a plurality of engagement notches, which are located on a circular trail of the engaging member as it moves by rotation, are formed on the opposing hook side of the lower part of the other hook, thereby allowing the engaging member to engage with one engagement notch selected from the plurality of engagement notches.

Accordingly, by having the engaging member engaged with one engagement notch selected from the plurality of engagement noches, the angles of the holding members against the cylindrical shell can be changed with a resulting change in the sandwiching distance between the holding members and the gripping member. As a result, it has become possible to have packing materials, each of which has a thickness different from before or others, joined together more readily.

Particularly preferred is that a tab on one of the pair of hooks and the engaging member on the tip end of the tabre disposed on each of two ribs formed on the inside surface of the hook, the two ribs standing upright on the foregoing inside surface of the hook and opposing to each other, and the plurality of engagement notches on the other hook are formed on the inside surface of each of two ribs, the two ribs standing upright on the foregoing inside surface of the other hook and opposing to each other, thereby allowing the two engaging members to be guided between the two ribs on the other hook and to engage with one engagement notch selected from the plurality of engagement notches. Accordingly, when the engaging member is engaged with one engagement notch selected from the plurality of engagement notches, the engaging member moving by rotation is guided by the two ribs to allow the engaging member to engage with the engagement notch easily and securely.

Particularly preferred is that two ribs opposing to each other, each of which is provided with a tab and located on one of the pair of hooks, are made freely movable together with the tabs due to elasticity so as to make the distance between the two ribs smaller and, by lessening the foregoing distance, the engagement with the engagement notches formed on the inside surfaces of the two ribs located on the other hook by opposing to each other is allowed to be released. Accordingly, by holding the two tabs with fingers to lessen the distance between the two tabs, the engagement with the engagement notches cn be readily released.

Particularly preferred is that the foregoing cylindrical shell gripping member, hinges, pair of hooks, tabs and plurality of engagement notches are formed of a plastic material by molding in one piece. The hinges are made thicker than the cylindrical shell and the pair of hooks. Accordingly, the fastening device can be easily produced by molding, thereby realizing a low production cost.

Next, a detailed description is made on an exemplary embodiment of the present invention with reference to drawings.

Figure 2:
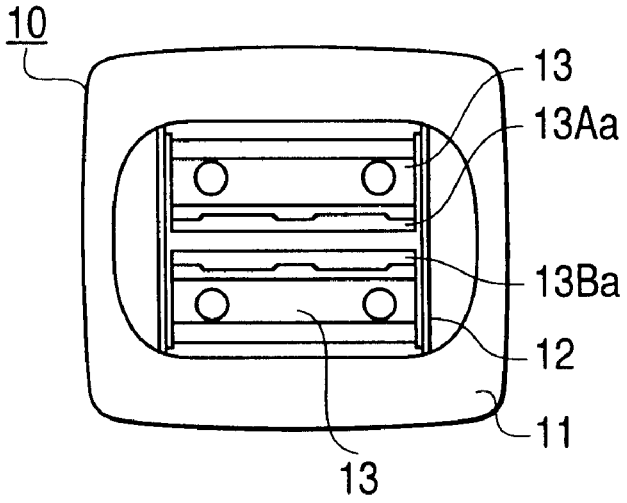
FIG. 2 is a back view of the fastening device of FIG. 1.
Figure 3A:
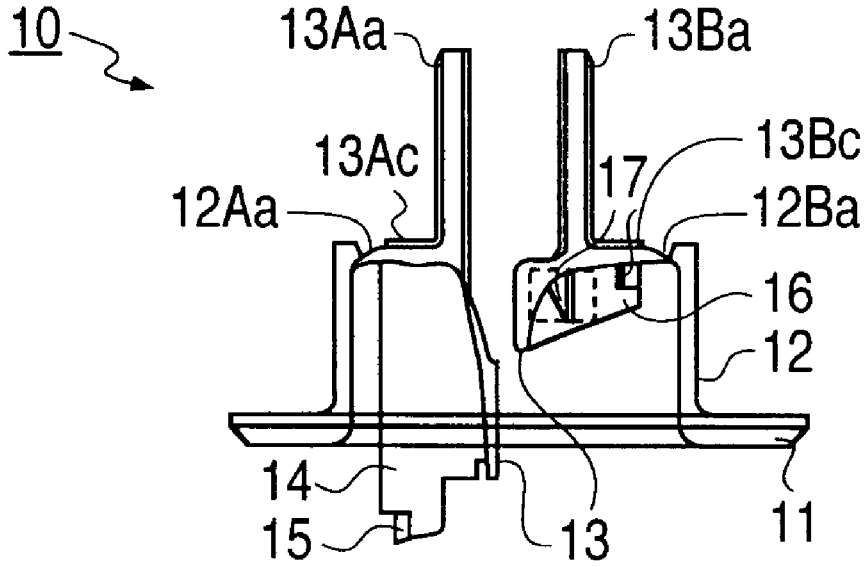
FIG. 3 (*a*) is a cross-sectional view of the fastening device of FIG. 1, FIG. 3 (*b*) is a perspective outline view of a first hook of the fastening device of FIG. 1 and FIG. 3 (*c*) is a perspective outline view of a second hook of the fastening device of FIG. 1.
Figure 3B:
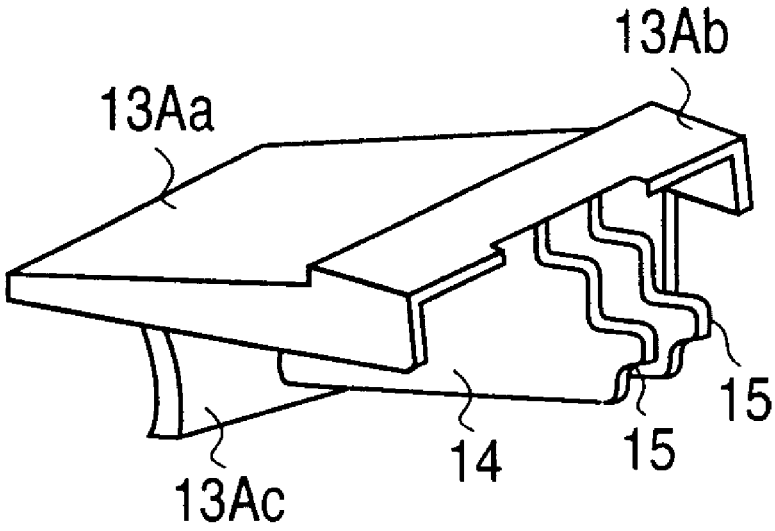
Figure 3C:
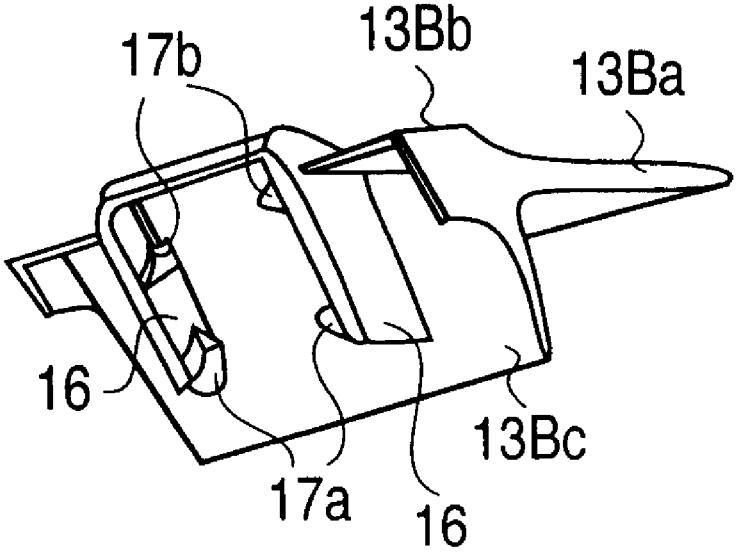
Figure 4:
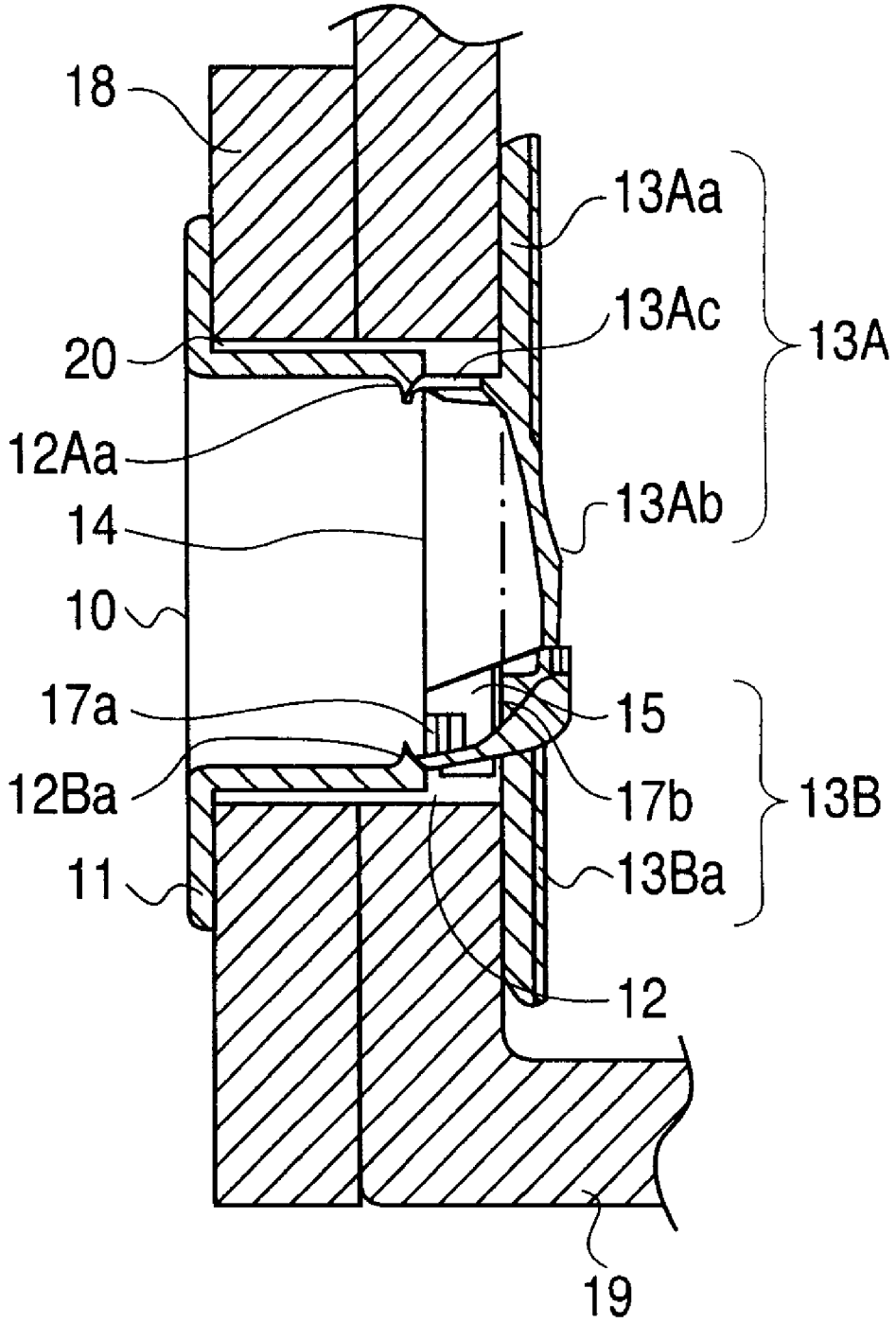
FIG. 4 is a cross-sectional view to show how two boxes are joined together by using the fastening device of FIG. 1.
Figure 5:
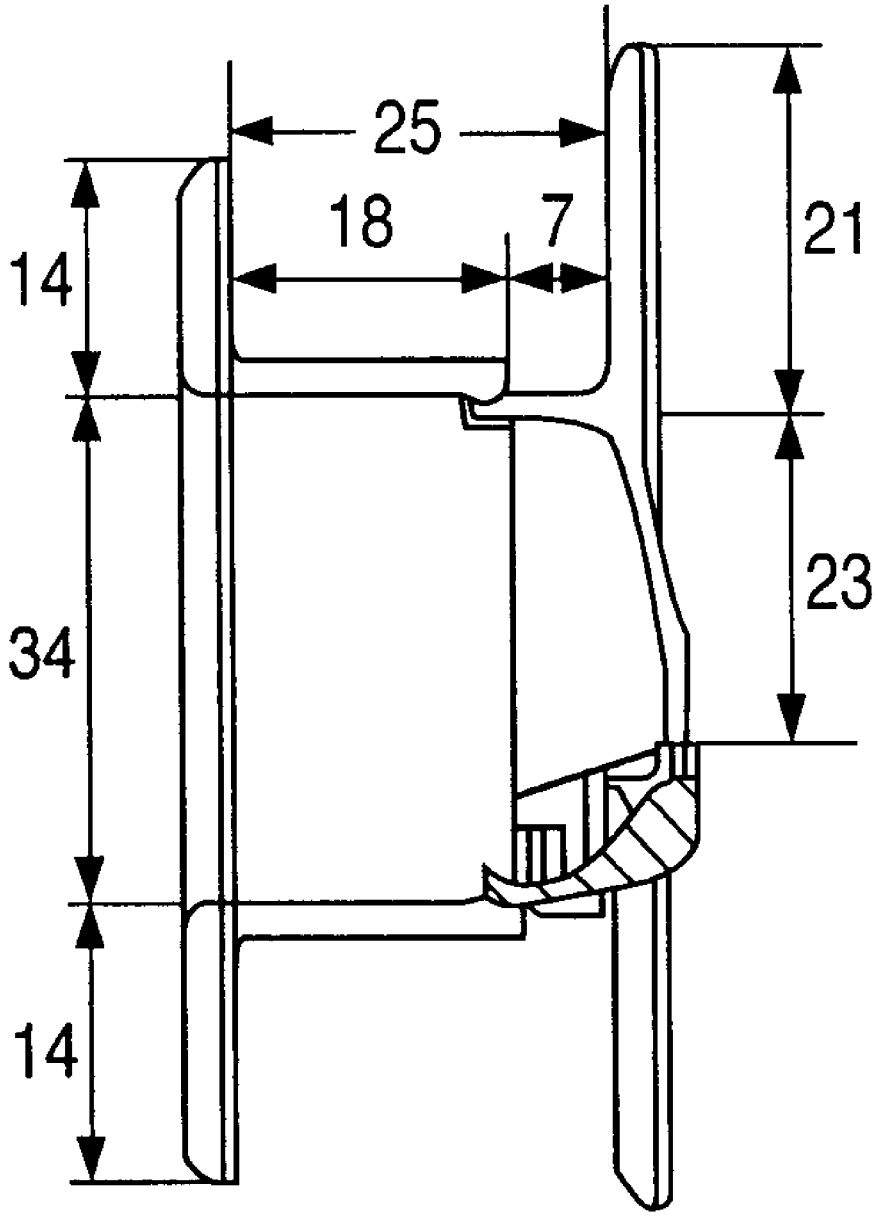
FIG. 5 is a cross-sectional view to show how a sandwiching distance measures when the fastening device of FIG. 1 is used.
Figure 6:
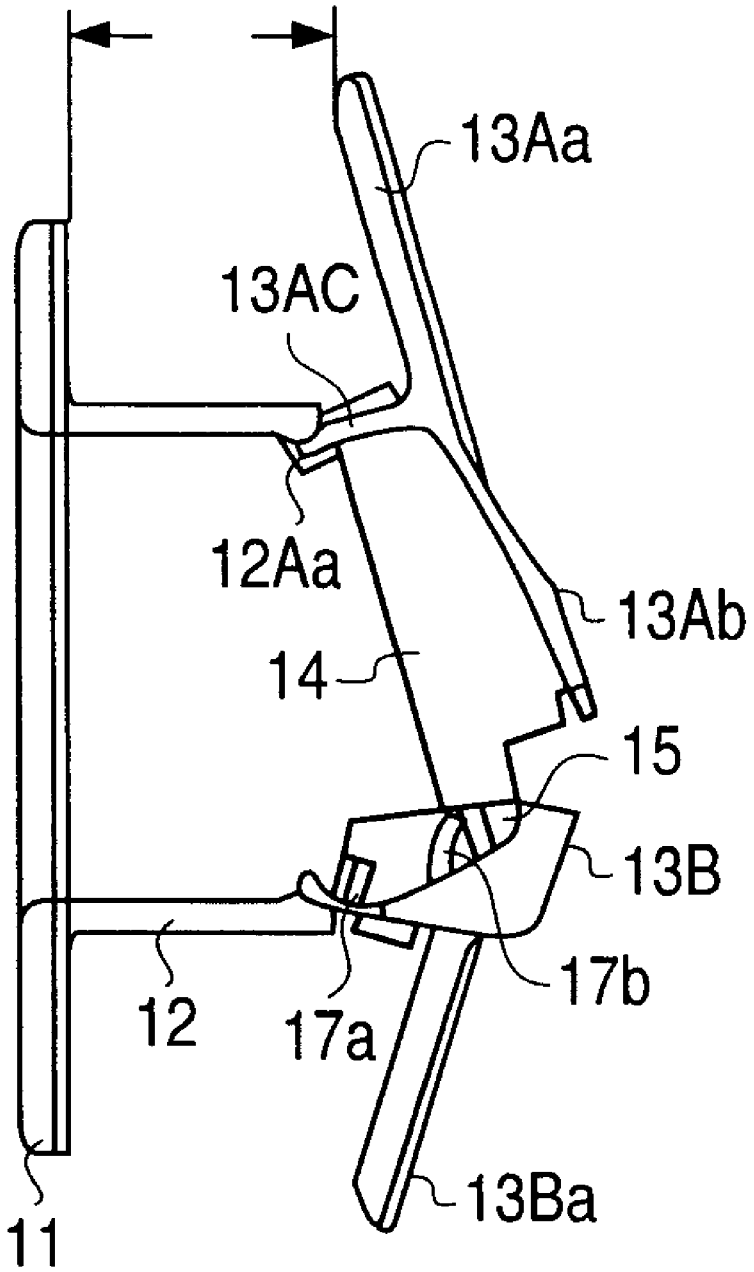
FIG. 6 is a cross-sectional view to show how the sandwiching distance changes from FIG. 5 when the fastening device of FIG. 1 is used.
Figure 7A:
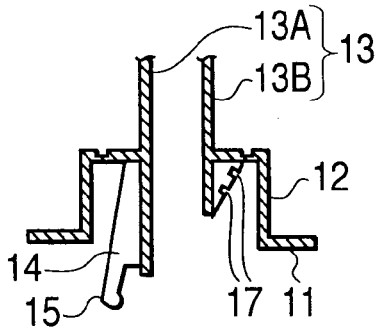
FIG. 7 shows cross-sectional views of a fastening method as applied to a packing box in an exemplary embodiment of the present invention.
Figure 7B:
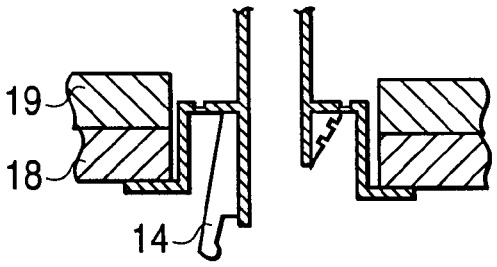
Figure 7C:
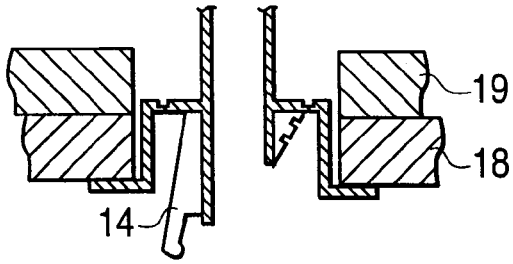
Figure 7D:
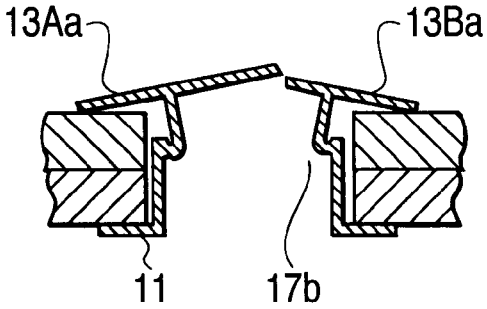
Figure 7E:
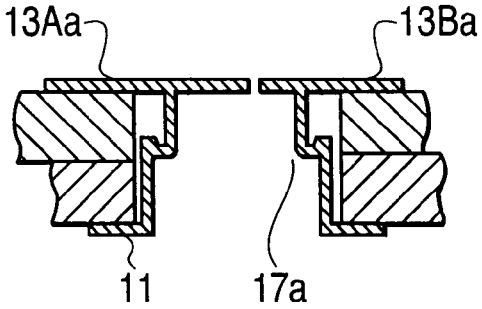
Figure 8:
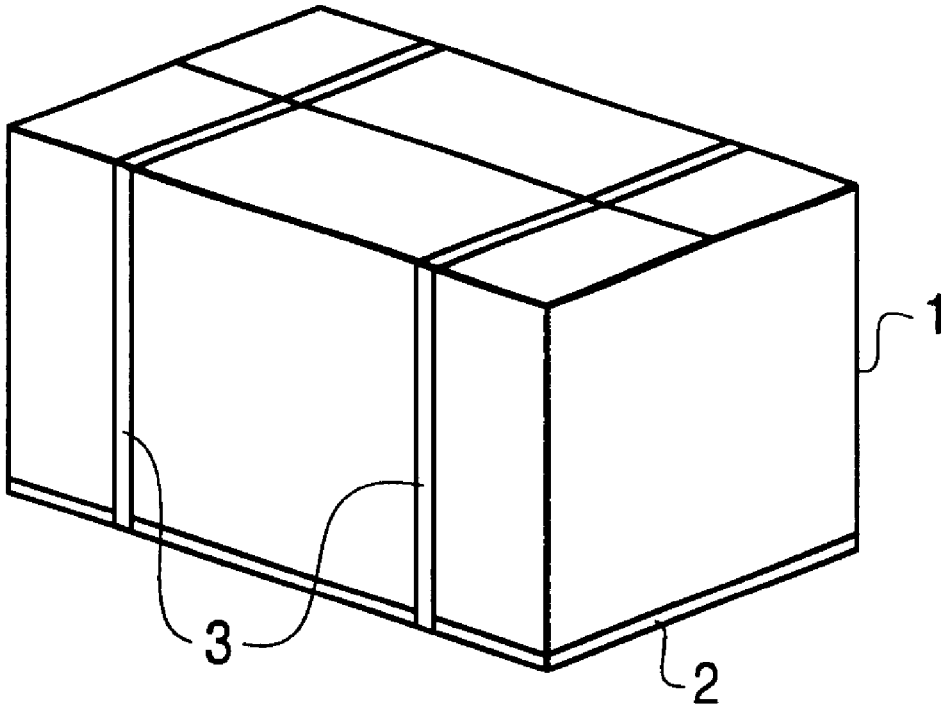
FIG. 8 (PRIOR ART)
FIG. 8 is a perspective view of a prior art fastening device.
Figure 9:
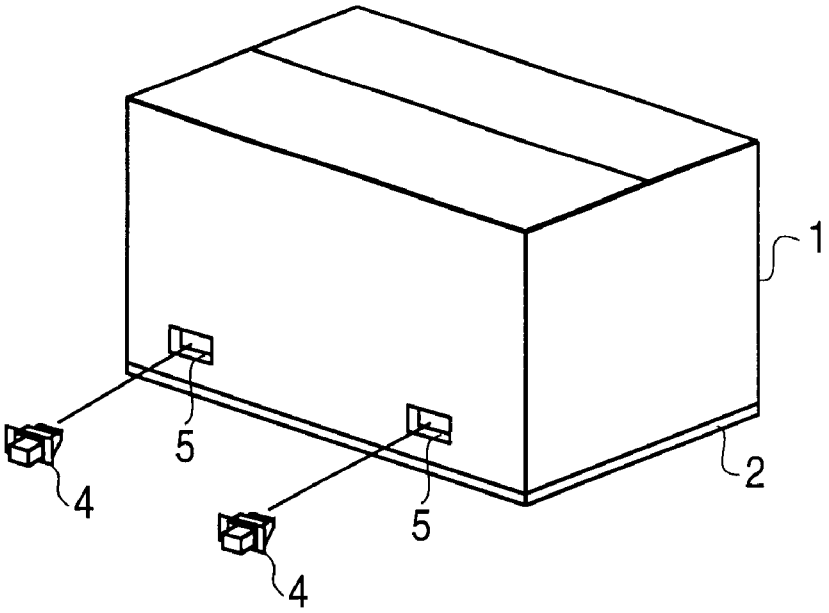
FIG. 9 (PRIOR ART)
FIG. 9 is a perspective view of another prior art fastening device.
Figure 10:
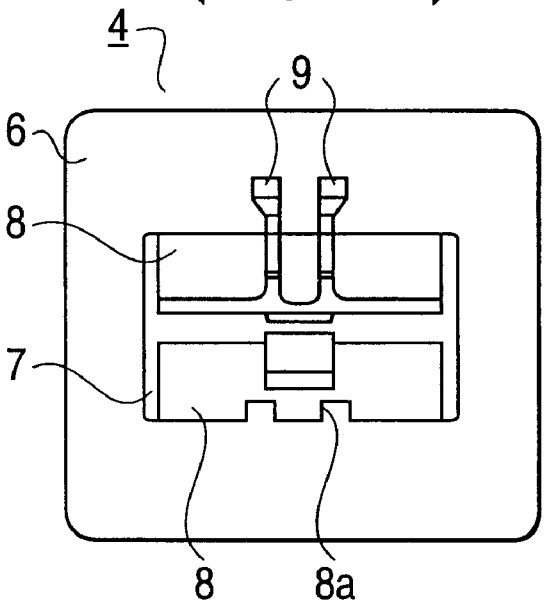
FIG. 10 (PRIOR ART)
FIG. 10 is a plan view of a prior art fastening device.
Figure 11:
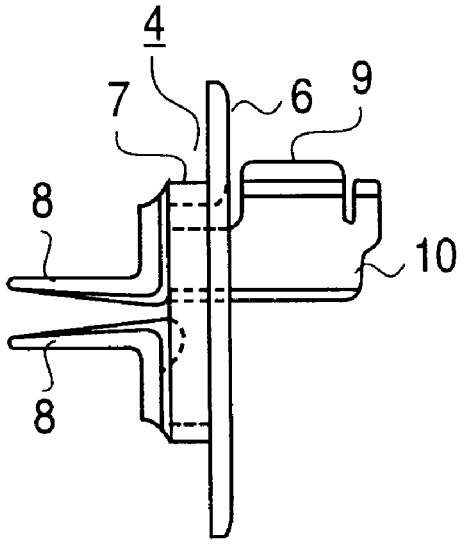
FIG. 11 (PRIOR ART)
FIG. 11 is a side view of the prior art fastening device of FIG. 10.
Figure 12:
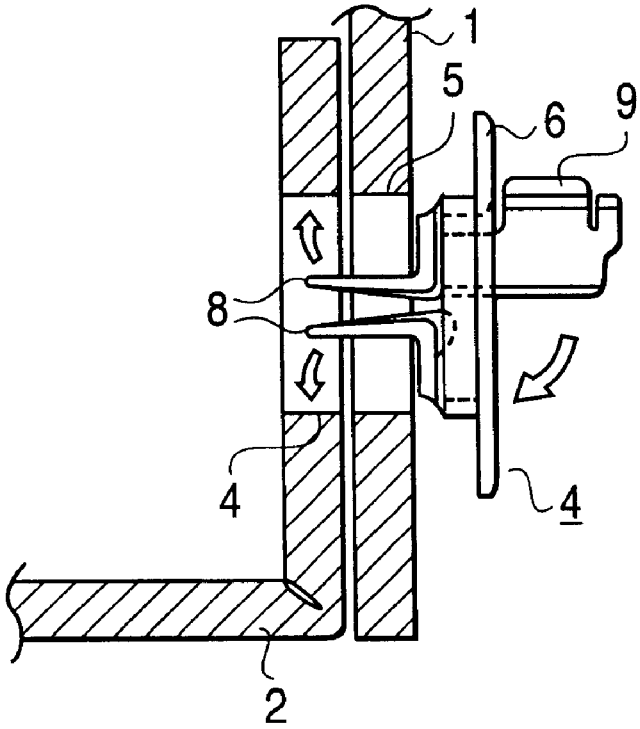
FIG. 12 (PRIOR ART)
FIG. 12 is a diagram to describe how the prior art fastening device of FIG. 10 works in joining two plates together.
Figure 13:
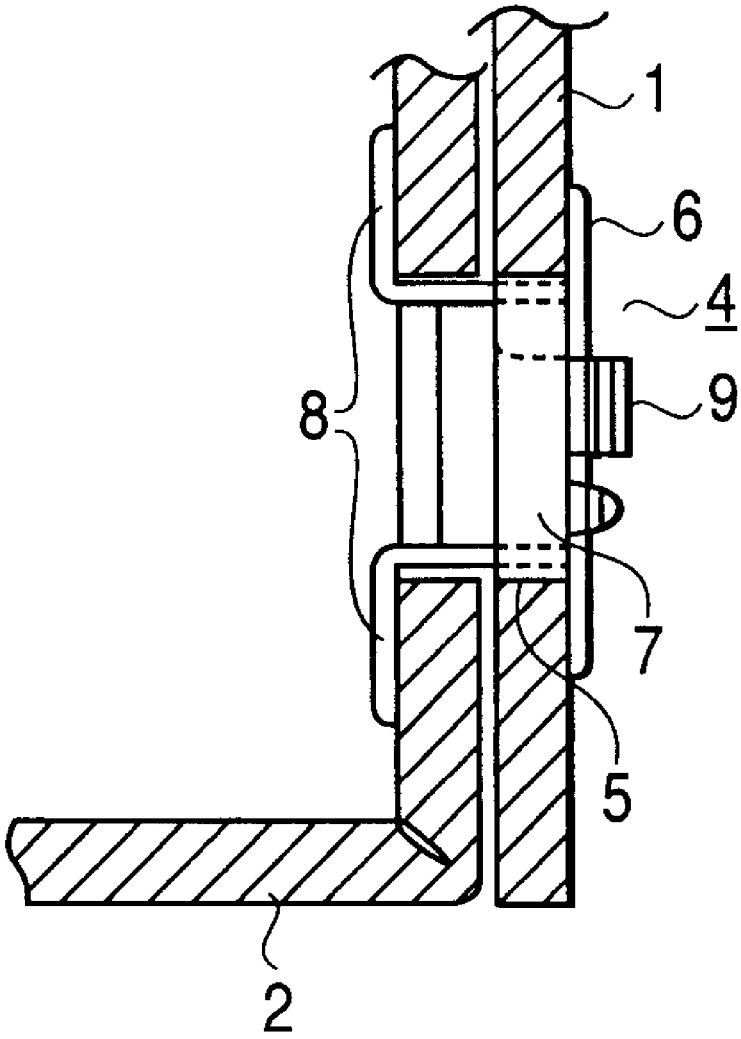
FIG. 13 (PRIOR ART)
FIG. 13 is another diagram to describe how the prior art fastening device of FIG. 10 works in joining two plates together.

FIG. 1 is a front view of a fastening device for use with a packing box in an exemplary embodiment of the present invention, FIG. 2 is a back view of the fastening device, FIG. 3(*a*) is a cross-sectional view of the fastening device, FIG. 4 is a cross-sectional view to show the fastening device in a state of fastening, FIG. 5 and FIG. 6 are cross-sectional views showing changes in the sandwiching distance of the fastening device and FIG. 7 shows a fastening method for joining an upper box and a lower box together by using the fastening device.

As FIG. 1 to FIG. 3 show, a fastening device 10 for use with a packing box comprises a cylindrical shell 12 having dose to a square in cross section, a flange 11 serving as a gripping member formed in one piece with the cylindrical shell 12 on the edge of one opening of the cylindrical shell 12 by extending outward and a pair of hooks 13, each of which has close to a T-letter like shape in cross section, linked with two sides of the other opening of the cylindrical shell 12 via hinges (a first hinge 12A*a,* a second hinge 12B*a*), respectively, the two sides being situated opposite to each other. The hinges 12A*a* and 12B*a* are formed in a thin structure, respectively. The fastening device 10 is made of a polypropylene material having elasticity to a degree and all the above componets are molded in one piece to realize a single-piece construction.

The pair of hooks 13, each of which has close to a T-letter like shape in ross section, have a first hook 13A and a second hook 13B. The first hook 13A includes a first vertical member 13A*c,* a first holding member 13A*a* of one part piece extending toward outside of the cylindrical shell 12 from the first vertical member 13A*c* serving as a base point and a first closing member 13A*b* of the other part piece extending from the base point of the first vertical member 13A*c* toward inside of the cylindrical shell 12 and having the function of closing the hollow body of the cylindrical shell 12.

The second hook 13B includes a second vertical member 13B*c,* a second holding member 13B*a* of one part piece extending toward outside of the cylindrical shell 12 from the second vertical member 13B*c* serving as a base point and a second closing member 13B*b* of the other part piece extending from the base point of the second vertical member 13B*c* and having the function of closing the hollow body of the cylindrical shell 12.

There is a tab 14 formed of two of a first lib opposing to each other, each of which extends from the inside surface of the first closing member 13A*b* to the inside surface of the first vertical member 13A*c* in the first hook 13A and makes a right angle with the inside surface of the first vertical member 13A*c* and also runs in parallel to the side located perpendicular to the width of the first hook 13A. Further, as FIG. 3(*b*) shows, an engaging member 15 formed of a shoulder like protrusion of a step-wise shape is provided on each respective tip end of the two of the tab 14.

As FIG. 3(*c*) shows, there are two of a second rib 16 formed opposing to each other, each of which extends from the inside surface of the second closing member 13B*b* to the inside surface of the second vertical member 13B*c* in the second hook 13B and makes a right angle with the inside surface of the second vertical member 13B*c* and also runs in parallel to the side located perpendicular to the width of the second hook 13B. Each respective second rib 16 is positioned outside of the respective engaging members 15 so that the two of the second rib 16 together serve as a guide for the engaging members 15 moving in a circular trail. Further, there are two of an engagement notch 17 formed on the inside surface of the second rib 16, both being located on a trail of the engaging member 15 as it moves by rotation. A first lock 17*a* and a second lock 17*b,* both made concave in shape, constitute the two of the engagement notch 17. The two of the engagement notch 17 can be made to have a plurality of locks exceeding two. The plurality of engagement notches 17 are located on a circular trail of the engaging member 15 as it moves by rotating around the first hinge 12A*a.* It is also possible for the second hook 13B to have no second closing member 13B*b* and to have the plurality of engagement notches 17 disposed on the second vertical member 13B*c,* instead.

The pair of hooks 13 and the cylindrical shell 12 of the fastening device 10 for use with a packing box of the foregoing structure are inserted in a hole 20 for fastening formed in common on an upper box 18 and a lower box 19 at a joining place as FIG. 4 shows while the position of the pair of hooks 13 being kept in parallel to the cylindrical shell 12 as FIG. 3(*a*) shows.

Then, while the pair of tabs 14 being held between two fingers, the first hook 13A is pushed into the inside of the cylindrical shell 12, thereby opening the pair of hooks 13 outward with the hinges 12A*a* and 12B*a* serving as a base point, respectively. At this time, the first holding member 13A*a* and the second holding member 13B*a* are brought into contact with the peripheral surface of the hole 20 for fastening on the inside surface of the lower box 19.

On the other hand, the flange 11 is brought into contact with the peripheral surface of the hole 20 for fastening on the outside surface of the upper box 18.

While this state being maintained, the engaging member 15 is engaged with one of the plurality of engagement notches 17. More specifically, the engaging member 15 is engaged with one of the first lock and second lock.

Thus, the first hook 13A and the second hook 13B are engaged with each other firmly. Furthermore, under this condition, the edges of the hole 20 for fastening of the upper box 18 and the lower box 19 are sandwiched between the first holding member 13A*a* and second holding member 13B*a* and the flange 11, thereby fixing the fastening device securely in place. At this time, the first closing member 13A*b* and second closing member 13B*b* close the opening of the cylindrical shell 12 by, thereby preventing foreign materials such as dust and the like from entering the cylindrical shell 12.

When the pair of tabs 14 are held between two fingers to reduce the distance therebetween due to warpage caused by an application of a squeezing force and the pair of tabs 14 are pushed up inside of the cylindrical shell 12, the shoulder like protrusion of the engaging member 15 on the tip end of the tab 14 is moved by being guided between the two of the second rib 16 on the second hook 13B and engaged with the engagement notch 17 protruding toward the inside of the second rib 16. Thus, the first hook 13A and second hook 13B are fixed to each other securely and at the same time the upper box 18 and the lower box 19 are joined together by getting sandwiched firmly between the first holding member 13A*a* and the flange 11 of the fastening device 10.

One of the features of the fastening device 10 of the present invention is in that the two of the engagement notch 17 protruding toward the inside of the second rib 16 are located on a circular trail of the engaging member 15 as it moves by rotation, which is allowed to get engaged with one selected from the two of the engagement notch 17. When the engaging member 15 is engaged with the lower positioned first engagement notch 17*a,* both of the first holding member 13A*a* and second holding member Ba are made almost in parallel with the surface of the flange 11 as FIG. 5 shows, thereby sandwiching tightly the edges of the hole 20 for fastening of the upper box 18 and lower box 19.

On the other hand, when the combined thickness of the upper box 18 and lower box 19 is small, the engaging member 15 is made to engage with the upper positioned second engagement notch 17*b*. At this time, as FIG. 6 shows, the holding members 13A*a* and 13B*a* are slanting, resulting in a reduced distance between the tip ends of the holding members 13A*a* and 13B*a* and the flange 11. Therefore, the same fastening device 10 can be used to join together the upper box 18 and lower box 19 with each respective thickness thereof differing from before or others. By increasing the number of the plurality of engagement notches 17, an upper box 18 and lower box 19 showing a variety of values in the combined thickness can be joined together easily, thereby building a packing box with various values in thickness.

In addition, the fastening device 10 for use with a packing box is formed of an elastic material Therefore, when the engaging member 15 is engaged with the engagement notch 17; the engaging member 15 is allowed to engage with the first lock or second lock easily due to the elasticity of the material used in the fastening device 10. By the same token, the tab 14 also shows elasticity, thereby allowing two of the tab 14 to be held by fingers so as to reduce the distance between the two tabs 14.

Therefore, the engaging member 15 is displaced toward inside readily. As a result, the engaging member 15 is allowed to be released from the foregoing engaging notch 17 with ease.

FIG. 7 shows schematic sketches of the steps of the fastening method for use with a packing box, using the foregoing fastening device.

To start with, a fastening device 10 as shown in FIG. 7(*a*) is made available. The structure of the fastening device 10 is the same as described with reference to FIG. 1 to FIG. 6. More specifically, the fastening device 10 comprises a cylindrical shell 12, a pair of hooks 13 and a gripping member 11. The pair of hooks 13 include a first hook 13A and a second hook 13B. The first hook 13A has an engaging member 15.

The second hook 13B has a plurality of engagement notches 17. The first hook 13A shows close to a T-letter like shape in cross section and is linked to the cylindrical shell 12 via a first hinge 12A*a*. The second hook 13B shows dose to a T-letter like shape in cross section and is linked to the cylindrical shell 12 via a second hinge 12B*a*. Then, this fastening device 10 is pushed into a through hole formed of holes for fastening of a lower box 19 and an upper box 18. FIG. 7(*b*) and FIG. 7(*c*) show a state where the fastening device 10 has been pushed into the through hole formed of the holes for fastening of the lower box 19 and the upper box 18. It is to be noted that the combined thickness of the lower box 19 and upper box 18 in FIG. 7(*b*) is smaller than that in FIG. 7(*c*). Next, two of a tab 14 are held by fingers and pushed in toward the lower box 19. At this time, a first holding member 13A*a* and a second holding member 13B*a* of the pair of hooks 13 are brought into contact with the surface of the lower box 19. On the other hand, the gripping member 11 is in contact with the surface of the upper box 18. Thus, the upper box 18 and lower box 19 are sandwiched between the pair of hooks 13 (the first holding member 13A*a* and the second holding member 13B*a* ) and the gripping member 11 and fastened together securely. FIG. 7(*d*) shows a state where the engaging member 15 has been engaged with a second engagement notch 17*b* and FIG. 7(*e*) shows a state where the engaging member 15 has been engaged with a fist engagement notch 17*a*.

More specifically, by selecting one engagement notch (17*a,* 17*b*) from the plurality of engagement notches 17, angles of the pair of hooks 13 against the cylindrical shell 12 change and according to the changes in the foregoing angles the sandwiching distance between the pair of hooks 13 (the first holding member 13A*a* and the second holding member 13B*a* ) changes.

Therefore, it is made possible for packing boxes, each having a thickness different from before or the other, to be fastened together easily. It is to be noted that each of the plurality of notches is located on a circular trail of the engaging member as it moves by rotating around the first hinge.

Polypropylene is used as the material for the fastening device 10 in the present exemplary embodiment but other high polymer materials having elasticity such as poly (ethyleneterephthalate), polyethylene, polyvinylchloride, polyethylene and the like can also be used.

As FIG. 5 shows, the fastening device 10 in the present exemplary embodiment has the dimensions as follows:

The distance between side walls of the cylindrical shell 12, with the longer side of which each of the pair of hooks 13 is linked: 34 mm The length of the cylindrical shell 12: 18 mm The length of the extended section of the flange 11: 14 mm The length of the holding member 13*a* of the hook 3 which has close to a T-letter like shape in cross section: 21 mm The length of the closing member 13*b* of the hook 3 which has dose to a T-letter like shape in cross section: 23 mm The length of the vertical member 13*c* of the hook 3 which has dose to a T-letter like shape in cross section: 7 mm The distance between the first engagement notch 17*a* and the second engagement notch 17*b:* 7 mm In this case, as FIG. 5 shows, the sandwiching distance between the flange 11 and the holding members 13A*a* and 13B*a* is 25 mm after the engaging member 15 has been engaged with the lower situated first engagement notch 17*a* (the first lock).

In contrast, when the engaging member 15 is engaged with the upper situated second engagement notch 7*b* (the second lock) as FIG. 6 shows, the sandwiching distance between the falnge 11 and the holding members 13A*a* and 13B*a* is 20 mm. In this came, packing boxes, each having a thickness thinner than before or the other, can be fastened together with ease.

Moreover, the foregoing sandwiching distance can be adjusted to become smaller step by step by increasing the number of locks of the plurality of notches 17, thereby facilitating the preparation of a suitable fastening device according to the variation in thickness of the corrugated cardboards used for packing boxes. In addition, the size of the cylindrical shell 12, the dimensions of each of the holding members 13A*a* and 13B*a* of the pair of hooks 13, the distance between the first engagement notch 17*a* and the second engagement notch 17*b* and the like are not governed by the afore-mentioned numbers but can be set to arbitrary numbers.

Thus, with the fastening device for use with a packing box in the present exemplary embodiment, by opening the fastening device via the operation of pushing in or closing via the operation of pulling out while holding the pair of tabs 14 between fingers, an upper box and a lower box can be joined together or separated easily with a single motion by using the fastening device. The fastening is performed so securely that the condition of fastening does not loosen even during transportation.

The cylindrical shell of the fastening device has an opening that is big enough for accommodating fingers and the opening can serve as a grip for holding the packing boxes. Since the component parts of the fastening device are designed to have continuity with one another in structure, all the component parts can be made in one-piece. In particular, the engaging member 15 is engaged with one notch selected from the plurality of notches 17, thereby allowing the opening angles of the pair of hooks 13 against the cylindrical shell 12 to be adjustable and also allowing the sandwiching distance between the flange 11 and the holding members 13A*a* and 13B*a* to be adjustable. As a result, it has become possible for packing boxes, each having a variety of thicknesses, to be fastened together with ease.

Further with the present exemplary embodiment, each respective engagement notch (17*a,* 17*b* ) of the plurality of notches 17 is made concave and the engaging member 15 has a shoulder like protrusion of a step-wise shape, which is locked after having been engaged with the concavity, thereby having the first hook 13A and second hook 13B engaged with each other securely. The configuration of the engagement notch 17 and engaging member 15 is not needed to be governed by the foregoing configuration, respectively, and other configurations can be employed as far as such other configurations assure a good engagement and secure locking between the engagement notch 17 and the engaging member 15. For example, the configuration of the engagement notch 17 can be like a concavity surrounded by a plurality of projections.

Further with the present exemplary embodiment, the gripping member 11 is shaped like a flange formed around the periphery of the cylindrical shell 12. However, the gripping member 11 is not necessarily governed by the foregoing configuration but can be such structures as the gripping member is close to a square in cross section and formed only on two sides that are opposing to each other, the gripping member has slots formed therein like a comb, the gripping member is formed of protrusions on arbitrary positions of the periphery of the cylindrical shell and the like as far as a gripping member of such structures can grip the upper box 18 firmly.

Furthermore, although each respective hook 13A or 13B of the pair of hooks 13 has dose to a T-letter like shape in cross section in the present exemplary embodiment, the configuration of each respective hook 13A or 13B is not necessarily governed by the above but can be such that each respective hook is rotatable around the hinge, thereby having the engaging member and engagement notch engaged and locked with each other and further having the holding member of each respective hook brought into contact with the surface of a packing box to sandwich the boards of packing boxes between the pair of hooks and the gripping member.

Still further, it is to be noted that such a structure is possible, where a slanting area is provided by extending between a second closing member, which protrudes from the inside surface of the second vertical member, and the second vertical member and the plurality of engagement notches are disposed on the foregoing slanting area with each respective engagement notch located on a circular trail of the engaging member as it moves by rotating around the first hinge.

Still further, such a structure is also possible, in which a plurality of engagement notches are disposed on the inside surface of the second vertical member and each respective engagement notch is located on a circular trail of the engaging member as it moves by rotating around the first hinge.

Still farther, such a structure is also possible, in which the positions of the upper box 18 and lower box 19 are reversed.

With the foregoing exemplary embodiment, the pair of hooks include a closing member that closes the opening of the cylindrical shell but the fastening device for use with a packing box of the present invention does not necessarily require the closing member that closes the opening of the cylindrical shell completely. What is important is that each respective hook of the pair of hooks has dose to a T-letter like shape in cross section.

A description has been given to a fastening device for use with a packing box that includes an upper box and a lower box in the foregoing exemplary embodiment but the fastening device is not only usable in the case where the upper box and the lower box are involved but it is also applicable to the case where just two plates are fastened together, replacing the upper box with a first plate and the lower box with a second plate in the foregoing exemplary embodiment.

As described in the above, the use of the fastening device of the present invention makes it possible to join the first plate and second plate together with ease. Furthermore, a variety of plate like materials, each having a different combined thickness resulted, can be joined together easily by the use of the fastening device of the present invention. In addition, the fastening device can also be used as a grip for holding the joined plates with hands.

What is claimed is:

1. A fastening device for use with a packing box comprising:

(a) a cylindrical shell of dose to a square in cross section;

(b) a flange formed in one-piece with said cylindrical shell so as to be extending outward from one of the openings of said cylindrical shell;

(c) a pair of hooks, each of which shows dose to a T-letter like shape in cross section and has a vertical member thereof linked via a hinge to one of the two sides of the other opening of said cylindrical shell, said two sides being located opposit to each other;

(d) a tab provided on the inside surface of one of said pair of hooks, said pair of hooks being allowed to open outward and close inward by pushing in and pulling out said tab, respectively; and (e) an engaging member formed on the inside surface of one hook of said pair of hooks and a plarality of engagement notches formed on the inside surface of the other hook of said pair of hooks, in which said engaging member and said engagement notches are allowed to engage with each other, an angle of said pair of hooks against said cylindrical shell is made variable by changing the position where said engaging member and said plurailty of notches are engaged with each other, and the distance between said flange and said pair of hooks is made variable by adjusting said angle, wherein an upper box and a lower box are joined together by first placing said pair of hooks and said cylindrical shell into a hole for fastening provided on said upper box and lower box while said upper box and lower box being superimposed with each other so as to have said holes for fastening aligned with each other and then by opening outward said pair of hooks to have the outside surface of said each respective hook brought into contact with the peripheral edges and surfaces ajoining thereto of said hole for fastening and at the same time to have said peripheral edges and surfaces adjoing thereto of said hole for fastening sandwiched between said outside surface of said each respective hook and the flange.

2. The fastening device according to claim 1, wherein said engaging member protrudes from the tip end of said tab toward said other hook;

said plurality of engagement notches are located on a trail of said engaging member as it moves by rotation; and said engaging member and one engagement notch of the plurality of engagement notches are allowed to engage with each other by selecting said one engagement notch from said plurality of engagement notches.

3. A fastening device according to claim 2, wherein said tab has two of a first rib that are opposing to each other and formed on the inside surface of one of said hooks perpendicularly thereto;

said engaging member is formed on each respective tip end of said two of the first rib;

the other of said hooks has two of a second rib that are opposing to each other and formed on the inside surface of said hook perpendicularly thereto;

said plurality of engagement notches are formed between said two of the second rib; and said two of the first rib are guided between said two of the second rib and also allowed to engage with one engagement notch selected from said plurality of engagement notches, respectively.

4. The fastening device according to claim 3, wherein both said two of the first rib and said tabs have elasticity and are allowed to move freely in such a direction as the distance therebetween is reduced, respectively, thereby allowing the engagement between said first rib and said engagement notch to be released.

5. A fastening device comprising:

(a) a shell provided with a first opening and a second opening, in which continuity exists between said first opening and said second opening;

(b) a gripping member formed on at least one of the periphery of said cylindrical shell near said first opening and the end of said cylindrical shell at said first opening by extending outward;

(c) a pair of hooks provided on the inner surface of said cylindrical shell near said second opening or on the end of said cylindrical shell at said second opening, in which said pair of hooks comprise a first hook linked with a first side of said second opening via a first hinge, and a second hook linked with a second side of said second opening via a second hinge, said second side being situated opposite to said first side, said first hook comprises a first vertical member linked to said first hinge, a first holding member formed on the outside surface of said first vertical member by extending outward from there, and a first closing member formed on the inside surface of said first vertical member by extending inward from there, and the second hook comprises a second vertical member linked to the second hinge, and a second holding member formed on the outside surface of said second vertical member by extending outward from there;

(d) an engaging member provided on the inside surface of at least one of said first closing member and said first vertical member; and (e) a plurality of engagement notches provided on the inside surface of at least one of said second closing member and said second vertical member, wherein said first hook and second hook are allowed to open outward and close inward by having said first closing member pushed in and pulled out, respectively, said engaging member is allowed to engage with said plurality of engagement notches, both of said first hook and second hook are allowed to change respective angles thereof against said cylindrical shell by having said engaging member engaged with one engagement notch selected from said plurality of engagement notches, and the distance between said gripping member and said pair of hooks is allowed to change by adjusting said angles, whereby an first plate provided with a first hole for fastening and a second plate also provided with a second hole for fastening are put together so that said respective holes for fastening may coincide with each other in position, then, said pair of hooks and shell are pushed into said first and second holes for fastening provided on the combination of said first and second plates, each respective hook of the pair of hooks is opened outward, thereby, while the outside surfaces of said first holding member and second holding member are contacted with the edge-adjoining surface around said holes, said edge-adjoining surface around said hole of said first plate and second plate are sandwiched between said first and second holding members and said gripping member, and at the same time said engaging member is engaged with said engagement notch, and thus allowing said first plate and second plate to be joined together by fastening.

6. The fastening device according to claim 5, wherein said first plate is a board constituting an upper box and said second plate is a board constituting a lower box and said fastening device allows said upper box and lower box to be joined together to make a combined packing box.

7. The fastening device according to claim 5, wherein each respective engagement notch of said plurality of notches is located on a circular trail of said engaging member as it moves around said first hinge.

8. The fastening device according to claim 5, wherein said engaging member has a protrusion formed by extending from the tip end of said first closing member toward said second hook.

9. The fastening device according to claim 5, further comprising a tab on at least one of said inside surface of said first closing member and the inside surface of said first vertical member, wherein said engaging member is formed on a tip end by protruding from said tab.

10. The fastening device according to claim 5, wherein said first hook has dose to a T-letter like shape in cross section, and the outside surface of said first holding member and the outside surface of said first closing member form the same plane.

11. The fastening device according to claim 5, wherein said second hook further has a second closing member protruding from the inside surface of said second vertical member;

said second hook has close to a T-letter like shape in cross section; and said plurality of engagement notches are disposed on both said second vertical member and said second closing member.

12. The fastening device according to claim 5, wherein said second hook further has a second closing member protruding from the inside surface of said second vertical member and a slanting member disposed between said second vertical member and said second closing member;

said plurality of engagement notches are disposed on said slanting member; and each respective engagement notch of said plurality engagement notches is located on a circular trail of said engaging member as it moves by rotating around said first hinge.

13. The fastening device according to claim 5, wherein said engaging member has a protrusion extending from the tip end of said tab toward said second hook;

each respective engagement notch of said plurality of engagement notches are located on a circular trail of said engaging member as it moves by rotating around said first hinge; and when said tab is pushed in, said first closing member moves by rotating around said first hinge and at the same time said protrusion is brought into contact with said second hook, thereby allowing said second hook to move by rotating around said second hinge.

14. The fastening device according to claim 5, wherein said tab has two of a first rib;

said engaging member is formed on the tip end of said respective two of the first rib;

said second hook has two of a second rib disposed on the inside surface of said second vertical member;

said plurality of engagement notches are formed between said two of the second rib; and said two of the first rib are guided between said two of the second rib and also said engaging member is allowed to engage with said one engagement notch selected from said plurality of engagement notches.

15. The fastening device according to claim 14, wherein said two of the first rib has elasticity so as to be freely movable in the direction to reduce the distance between said two of the first rib;

the engagement between said engaging member and said engagement notch can be released by an application of a force to reduce said distance between said two of the first rib; and upon relieving said force applied, said two of the first rib resume the original position by increasing said distance, thereby allowing said engaging member to engage with said engement notch again.

16. The fastening device according to claim 5, wherein said cylindrical shell, said gripping member, said hinges, said pair of hooks, said tab and said plurality of engagement notches are all formed of a plastic in one-piece; and said hinges are made smaller in thickness than said cylindrical shell and said pair of hooks.

17. The fastening device according to claim 5, wherein said first opening serves the function of a grip.

18. The fastening device according to claim 5, wherein said first closing member has the function of closing said second opening.

19. A fastening method for use in joining plates together comprising the steps of:

(1) supplying a fastening device, said device comprising:

(a) a shell provided with a first opening and a second opening, in which continuity exists between said first opening and said second opening;

(b) a gripping member formed on the periphery of said first opening by extending outward;

(c) a pair of hooks provided in the vicinity around said second opening;

said pair of hooks comprising:

a first hook liked with a first side of said second opening via a first hinge; and a second hook linked with a second side of said second opening via a second hinge, said second side is located opposite to said first side, said first hook comprising:

a first vertical member linked to said first hinge;

a first holding member formed on the outside surface of said first vertical member by extending outward from there; and a first closing member formed on the inside surface of said first vertical member by extending inward from there, and said second hook comprising:

a second vertical member linked to said second hinge; and a second holding member formed on the outside surface of said second vertical member by extending outward from there;

(d) an engaging member provided on the inside surface of at least one of said first closing member and said first vertical member; and (e) a plurality of engagement notches provided on the inside surface of at least one of said second closing member and said second vertical member, (2) overlaying a first plate on a second plate so that an first hole formed on said first plate is aligned with a second hole formed on said second plate;

(3) inserting said fastening device into said first hole and second hole and pushing in said fastening device untill said gripping member comes to contact with the the surface of said first plate;

(4) opening outward said first hook and second hook while pushing in said first closing member, thereby bringing said first holding member and second holding member into contact with the surface of said second plate to have said first plate and second plate sandwiched between said first holding member and second holding member and the gripping member; and (5) joining firmly said first plate and second plate together by said pair of hooks with said engaging member made to engage with one engagement notch of said plurality of engagement notches, wherein, by selecting one engagement notch from said plurality of engagement notches, the angles of both said first holding member and second holding member against said shell change and at the same time the distance between said gripping member and said pair of hooks is adjusted to become equal to the total thickness of said upper plate and lower plate put together.

20. The fastening method for use in joining plates together according to claim 19, wherein said first plate is a board constituting an upper box and said second plate is a board constituting a lower box; and said upper box and lower box are joined together to make a combined packing box according to said step (5).

21. The fastening method for use in joining plates together according to claim 19, wherein each respective engagement notch of said plurality of engagement notches is located on a circular trail of said engaging member as it moves by rotating around said first hinge.

22. The fastening method for use in joining plates together according to claim 19, wherein said engaging member has a protrusion formed by extending from the tip end of said first closing member toward said second hook.

23. The fastening method for use in joining plates together according to claim 19, further comprising a tab disposed on at least one of the inside surfaces of said first closing member and said first vertical member, wherein and said engaging member is formed on the tip end protruding from said tab.

24. The fastening method for use in joining plates together according to claim 19, wherein said first hook has dose to a T-letter like shape in cross section and the outside surface of said first holding member and the outside surface of said first closing member form the same plane.

25. The fastening method for use in joining plates together according to claim 19, wherein said second hook further has a second closing member protruding from the inside surface of said second vertical member;

said second hook has dose to a T-letter like shape in cross section; and said plurality of engagement notches are disposed on both said second vertical member and said second closing member.

26. The fastening method for use in joining plates together according to claim 19, wherein said second hook further has a second closing member protruding from the inside surface of said second vertical member and a slanting member disposed between said second vertical member and said second closing member;

said plurality of engagement notches are disposed on said slanting member; and each respective engagement notch of said plurality engagement notches is located on a circular trail of said engaging member as it moves by rotating around said first hinge.

27. The fastening method for use in joining plates together according to claim 19, wherein said first hook further has a tab disposed on inside surface of said first closing member;

said engaging member has a protrusion extending from the tip end of said tab toward said second hook;

each respective engagement notch of said plurality of engagement notches is located on a circular frail of said engaging member as it moves by rotating around said first hinge, and by pushing in said tab in said step (4), said first closing member moves by rotating around said first hinge and at the same time said protrusion is brought into contact with said second closing member, thereby said second closing member being moved by rotating around said second hinge.

28. The fastening method for use in joining plates together according to claim 19, wherein said first hook further has a tab disposed on inside surface of said first closing member;

said tab has two of a first rib;

said engaging member is formed on the tip end of each respective tab of said two of the tab;

said second hook has two of a second rib disposed on said inside surface of said second closing member;

said plurality of engagement notches are formed between said two of the second rib, and in said step (4) said two of the first rib are guided between said two of the second rib and also said engaging member is engaged with said one engagement notch selected from said plurality of engagement notches.

29. The fastening method for use with joining plates together according to claim 28, wherein said two of the first rib has elasticity and are allowed to move freely in such a direction as the distance therebetween is reduced;

in said step (4), while a force being applied to said two of the first rib in the direction of reducing said distance between said two of the first rib, said first closing member is pushed in and, when said force is relieved at the position where said engaging member engages with said engagement notch, the distance between said two of the first reib returns to the original distance and at the same time said engaging member finishes an engagement with said engagement notch.

30. The fastening method for use in joining plates together according to claim 19, wherein said cylindrical shell said gripping member, said hinges, said pair of hooks, said tab and said plurality of engagement notches are all formed of a plastic in one-piece; and said hinges are made smaller in thickness than said cylindrical shell and said pair of hooks.

* * * * *